US008329039B2

(12) United States Patent
Domke et al.

(10) Patent No.: US 8,329,039 B2
(45) Date of Patent: Dec. 11, 2012

(54) MAGNETIC SEPARATION OF SUBSTANCES ON THE BASIS OF THE DIFFERENT SURFACE CHARGES THEREOF

(75) Inventors: Imme Domke, Mannheim (DE); Alexej Michailovski, Mannheim (DE); Norbert Mronga, Dossenheim (DE); Hartmut Hibst, Schriesheim (DE)

(73) Assignee: BASF SE, Ludwigshafen (DE)

( * ) Notice: Subject to any disclaimer, the term of this patent is extended or adjusted under 35 U.S.C. 154(b) by 366 days.

(21) Appl. No.: 12/743,655

(22) PCT Filed: Nov. 17, 2008

(86) PCT No.: PCT/EP2008/065666

§ 371 (c)(1),
(2), (4) Date: May 19, 2010

(87) PCT Pub. No.: WO2009/065802

PCT Pub. Date: May 28, 2009

(65) Prior Publication Data

US 2010/0307982 A1 Dec. 9, 2010

(30) Foreign Application Priority Data

Nov. 19, 2007 (EP) ..... 07120973

(51) Int. Cl.
*B03C 1/023* (2006.01)

(52) U.S. Cl. ..... 210/695; 210/679; 210/714; 210/724; 210/222; 209/5; 209/8; 209/9; 209/39; 209/214

(58) Field of Classification Search ..... 210/679, 210/695, 714, 724, 222; 209/5, 8, 9, 39, 209/214

See application file for complete search history.

(56) References Cited

U.S. PATENT DOCUMENTS 4,219,408 A 8/1980 Price et al.
4,225,425 A 9/1980 Price et al.
4,225,426 A 9/1980 Price et al.
(Continued)

FOREIGN PATENT DOCUMENTS

WO 02 066168 8/2002

OTHER PUBLICATIONS

Gray S R et al., "Recovery of Fine Gold Particles by Flocculation With Hydrophobic Magnetite", Extractive Metallurgy Conference, pp. 223-226 Perth, (Oct. 2-4, 1991).

*Primary Examiner* — David A Reifsnyder
(74) *Attorney, Agent, or Firm* — Oblon, Spivak, McClelland, Maier & Neustadt, L.L.P.

(57) ABSTRACT

The present invention relates to a process for separating at least one first material from a mixture comprising this at least one first material and at least one second material, which comprises the steps:

(A) production of a suspension of the mixture comprising at least one first material and at least one second material and at least one magnetic particle in a suitable suspension medium, (B) setting of the pH of the suspension obtained in step (A) to a value at which the at least one first material and the at least one magnetic particle bear opposite surface charges so that these agglomerate, (C) separation of the agglomerate obtained in step (B) from the suspension by application of a magnetic field and (D) dissociation of the agglomerate separated off in step (C) by setting of the pH to a value at which the at least one first material and the at least one magnetic particle bear the same surface charges in order to obtain the at least one first material.

7 Claims, 1 Drawing Sheet

U.S. PATENT DOCUMENTS

| | | | |
|---|---|---|---|
| 4,643,822 | A | 2/1987 | Parsonage |
| 4,657,666 | A | 4/1987 | Snook et al. |
| 4,834,898 | A | 5/1989 | Hwang |
| 4,906,382 | A | 3/1990 | Hwang |
| 2011/0120954 | A1 | 5/2011 | Domke et al. |
| 2011/0240527 | A1 | 10/2011 | Domke et al. |
| 2011/0303773 | A1 | 12/2011 | Domke et al. |
| 2011/0309003 | A1 | 12/2011 | Domke et al. |

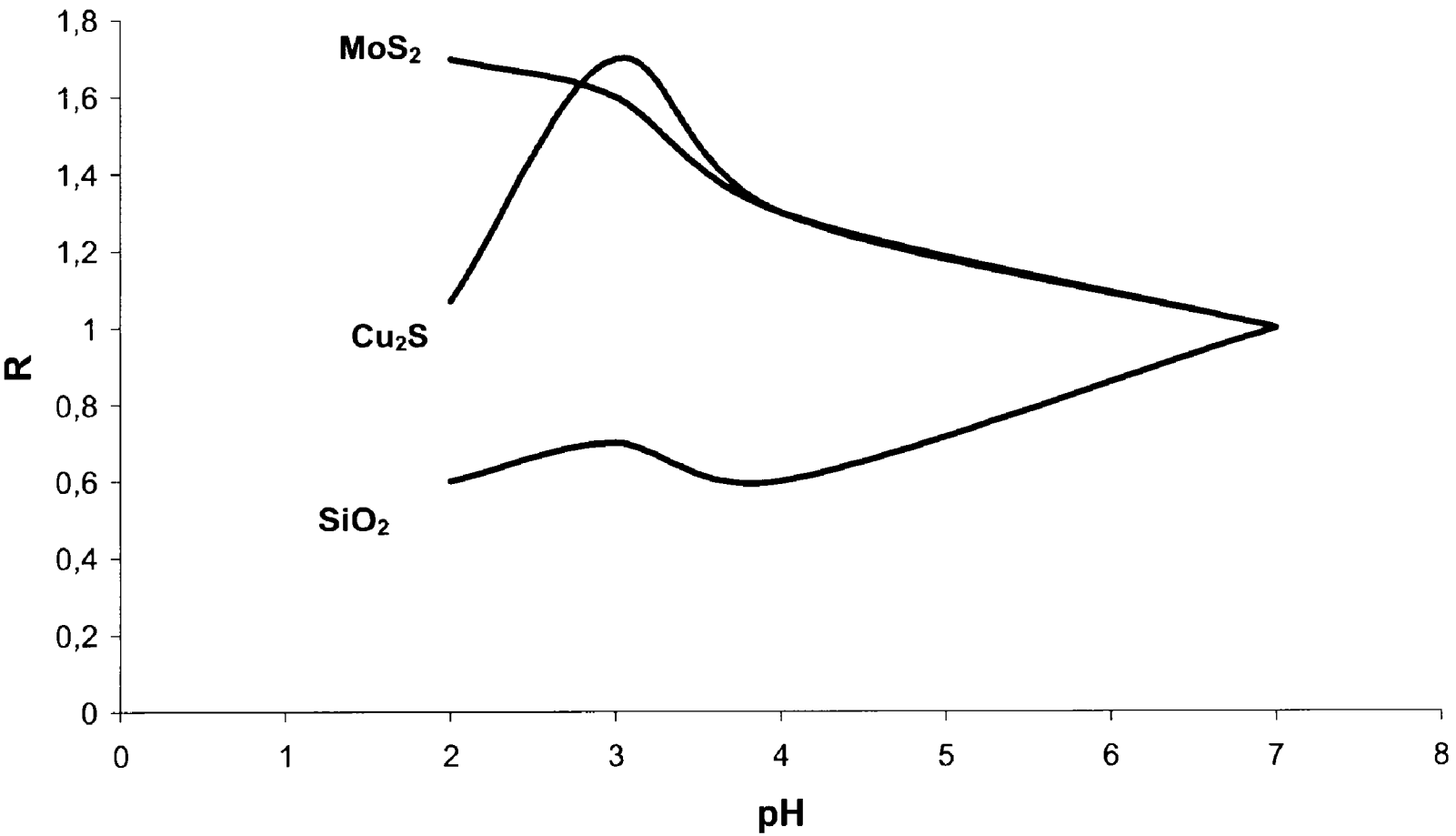
R
1,8
1,6
1,4
1,2
1
0,8
0,6
0,4
0,2
0
0
1
2
3
4
5
6
7
8
pH
$MoS_2$
$Cu_2S$
$SiO_2$

MAGNETIC SEPARATION OF SUBSTANCES ON THE BASIS OF THE DIFFERENT SURFACE CHARGES THEREOF

The present invention relates to a process for separating at least one first material from a mixture comprising this at least one first material and at least one second material, in which a suspension of the mixture comprising at least one first material and at least one second material and at least one magnetic particle in a suitable suspension medium is firstly produced, the pH of this suspension is set to a value at which the at least one first material and the at least one magnetic particle bear opposite surface charges so that these agglomerate, the agglomerate obtained in this way is separated off by application of a magnetic field gradient and this agglomerate which has been separated off is dissociated by setting the pH to a value at which the at least one first material and the at least one magnetic particle bear the same surface charges in order to obtain the at least one first material.

In particular, the present invention relates to a process for enriching ores in the presence of the gangue.

Processes for separating ores from mixtures comprising these are already known from the prior art.

WO 02/0066168 A1 relates to a process for separating ores from mixtures comprising these, in which suspensions or slurries of these mixtures are treated with particles which are magnetic and/or floatable in aqueous solutions. After addition of the magnetic and/or floatable particles, a magnetic field is applied so that the agglomerates are separated off from the mixture. However, the degree to which the magnetic particles are bound to the ores and the strength of the bond is not sufficient to carry out the process with satisfactory yield and effectiveness.

U.S. Pat. No. 4,657,666 discloses a process for the enrichment of ores, in which the ore present in the gangue is reacted with magnetic particles, so that agglomerates are formed as a result of the hydrophobic interactions. The magnetic particles are hydrophobicized on the surface by treatment with hydrophobic compounds, so that bonding to the ore occurs. The agglomerates are then separated off from the mixture by means of a magnetic field. The document mentioned also discloses that the ores are treated with a surface-activating solution of 1% of sodium ethylxanthogenate before the magnetic particle is added. Separation of ore and magnetic particle is in this process effected by destruction of the surface-activating substance which has been applied in the form of the surface-activating solution to the ore. A disadvantage of this process is that a surface-activating substance whose degradation products remain in the ore and may adversely affect further processing steps may be added.

U.S. Pat. No. 4,834,898 discloses a process for separating off nonmagnetic materials by bringing these into contact with magnetic reagents which are enveloped by two layers of surface-active substances. The bonding of the magnetic reagents which have been modified in this way to the nonmagnetic particles is based on interaction of the coating of the magnetic particles with the nonmagnetic materials. A disadvantage of this process is that the magnetic particles have to be provided with two layers of surface-active substances in a complicated fashion in order to achieve coupling.

S. R. Gray, D. Landberg, N. B. Gray, Extractive Metallurgy Conference, Perth, 2-4 Oct. 1991, pages 223-226, disclose a process for recovering small gold particles by bringing the particles into contact with magnetite. Before contacting, the gold particles are treated with potassium amylxanthogenate. A method of separating the gold particles from at least one hydrophilic material is not disclosed in this document.

It is an object of the present invention to provide a process by means of which at least one first material can be separated off efficiently from mixtures comprising at least one first material and at least one second material. A further object of the present invention is to provide a process by means of which it is possible to carry out the abovementioned separation of materials without the first and/or second material having to be treated with an additional reagent and in which the agglomeration with a magnetic particle can be brought about by simple measures and is reversible. Furthermore, the bond between the first material to be separated off and magnetic particles should be sufficiently stable to ensure a high yield of the first material in the separation.

The objects are achieved by the process of the invention for separating at least one first material from a mixture comprising this at least one first material and at least one second material, which comprises the steps:

(A) production of a suspension of the mixture comprising at least one first material and at least one second material and at least one magnetic particle in a suitable suspension medium, (B) setting of the pH of the suspension obtained in step (A) to a value at which the at least one first material and the at least one magnetic particle bear opposite surface charges so that these agglomerate, (C) separation of the agglomerate obtained in step (B) from the suspension by application of a magnetic field and (D) dissociation of the agglomerate separated off in step (C) by setting of the pH to a value at which the at least one first material and the at least one magnetic particle bear the same surface charges in order to obtain the at least one first material.

The process of the invention is preferably employed for separating at least one first material from a mixture comprising this at least one first material and at least one second material.

The at least one first material and the at least one second material can be separated from one another by the process of the invention since they have different surface charges depending on the pH set. According to the invention, it is necessary for the at least one first material and the at least one magnetic particle to have different surface charges at the pH set.

In a preferred embodiment, the at least one first material is selected from the group consisting of sulfidic ores, oxidic and/or carbonate-comprising ores and mixtures thereof.

The at least one first material to be separated off is thus preferably a metal compound selected from the group consisting of sulfidic ores, oxidic and/or carbonate-comprising ores, for example azurite $[Cu_3(CO_3)_2(OH)_2]$ or malachite $[Cu_2[(OH)_2CO_3]]$. Furthermore, the at least one material to be separated off can be selected from the group consisting of the noble metals and their compounds, for example Au, Pt, Pd, Rh, etc, preferably in the native state.

Examples of sulfidic ores which can be used for the purposes of the invention are, for example, selected from the group of copper ores consisting of covellite CuS, molybdenum(IV) sulfide molybdite $MoS_2$, chalcopyrite (copper pyrite) $CuFeS_2$, bornite $Cu_5FeS_4$, chalcocite (copper glass) $Cu_2S$ and mixtures thereof.

The at least one second material is preferably selected from the group consisting of oxidic metal compounds, hydroxidic metal compounds and mixtures thereof, for example silicon dioxide $SiO_2$, silicates, aluminosilicates, for example feldspars, for example albite $Na(Si_3Al)O_8$, mica, for example muscovite $KAl_2[(OH,F)_2AlSi_3O_{10}]$, garnets $(Mg, Ca, Fe^{II})_3(Al, Fe^{III})_2(SiO_4)_3$, $Al_2O_3$, $FeO(OH)$, $FeCO_3$, $Fe_2O_3$, $Fe_3O_4$ and further related minerals and mixtures thereof. Further preferred oxidic compounds are mentioned below.

The process of the invention is preferably carried out using untreated ore mixtures which are obtained from mine deposits.

In a preferred embodiment of the process of the invention, the mixture comprising at least one first material and at least one second material in step (A) is in the form of particles having a size of from 100 nm to 100 μm, see, for example, U.S. Pat. No. 5,051,199. In a preferred embodiment, this particle size is obtained by milling. Suitable processes and apparatuses are known to those skilled in the art, for example wet milling in a ball mill. A preferred embodiment of the process of the invention therefore provides for the mixture comprising at least one first material and at least one second material to be milled to particles having a size of from 100 nm to 500 μm before or during step (A). Preferred ore mixtures have a content of sulfidic minerals of at least 0.4% by weight.

Examples of sulfidic minerals which are present in the mixtures which can be used according to the invention are those mentioned above. In addition, sulfides of metals other than copper, for example sulfides of iron, lead, zinc or molybdenum, i.e. $FeS/FeS_2$, PbS, ZnS or $MoS_2$, can also be present in the mixtures. Furthermore, oxidic compounds of metals and semimetals, for example silicates or borates or other salts of metals and semimetals, for example phosphates, sulfates or oxides/hydroxides/carbonates and further salts, for example azurite $[Cu_3(CO_3)_2(OH)_2]$, malachite $[Cu_2[(OH)_2(CO_3)]]$, barite ($BaSO_4$), monazite ((Ce, La, Nd) $[PO_4]$), can be present in the ore mixtures to be treated according to the invention. Further preferred sulfidic compounds are mentioned below.

A typical ore mixture which can be separated by the process of the invention has the following composition: about 30% by weight of $SiO_2$, about 10% by weight of $Na(Si_3Al)O_8$, about 3% by weight of $Cu_2S$, about 1% by weight of $MoS_2$, balance chromium, iron, titanium and magnesium oxides.

The individual steps of the process of the invention are described in detail below:

Step (A):

Step (A) of the process of the invention comprises the production of a suspension of the mixture comprising at least one first material and at least one second material and at least one magnetic particle in a suitable suspension medium.

Suitable and preferred first and second materials have been mentioned above.

As magnetic particles, it is possible to use all magnetic particles which are known to those skilled in the art and meet the requirements of the process of the invention, for example suspendability in the suspension medium used and the ability to agglomerate with the at least one first material. Furthermore, the at least one magnetic particle should have a defined occupation of its surface by surface charges at a defined pH. These surface charges can be quantified by the potential.

In a preferred embodiment, the at least one magnetic particle is selected from the group consisting of metallic metals, for example iron, cobalt, nickel and mixtures thereof, ferromagnetic alloys of magnetic metals, magnetic iron oxides, for example magnetite, maghemite, cubic ferrites of the general formula (II)

$$M^{2+}{}_xFe^{2+}{}_{1-x}Fe^{3+}{}_2O_4 \quad \text{(II)}$$

where

M is selected from among Co, Ni, Mn, Zn and mixtures thereof and $x \leqq 1$, hexagonal ferrites, for example barium or strontium ferrite $MFe_6O_{19}$ where M=Ca, Sr, Ba, and mixtures thereof.

If metallic nanoparticles are used, these are preferably provided with a protective coating, for example an $SiO_2$ coating. The isoelectric point (IEP) of the magnetic particle is then replaced by the IEP of the protective coating. The suitability of the magnetic particle for the separation according to the invention is then determined correspondingly.

In a particularly preferred embodiment of the present application, the at least one magnetic particle is magnetite $Fe_3O_4$ or cobalt ferrite $Co^{2+}{}_xFe^{2+}{}_{1-x}Fe^{3+}{}_2O_4$ where $x \leqq 1$, for example $CO_{0.25}Fe_{2.75}O_4$.

The size of the magnetic particles used according to the invention is from 10 nm to 1 μm.

Step (A) of the process of the invention can, in one embodiment, be carried out by firstly suspending the mixture of at least one first material and at least one second material in a suitable suspension medium and subsequently adding the at least one magnetic particle to the suspension. Before addition of the at least one magnetic particle, the suspension of the mixture of at least one first material and at least one second material can, if appropriate, be stirred until a homogeneous suspension is present. Suitable apparatuses are known to those skilled in the art.

In an another embodiment of the process of the invention, a mixture comprising the mixture of at least one first material and at least one second material and at least one magnetic particle is firstly produced and this mixture is subsequently suspended in a suitable suspension medium in step (A).

In step (A) of the process of the invention, all suspension media in which the mixture from step (A) is not soluble to a significant extent are suitable as suspension media. Suitable suspension media for producing the suspension as per step (A) of the process of the invention are preferably selected from the group consisting of water, water-soluble organic compounds, for example alcohols having from 1 to 4 carbon atoms, and mixtures thereof. In a particularly preferred embodiment, the suspension medium in step (A) is water.

Step (A) of the process of the invention is generally carried out at a temperature of from 1 to 80° C., preferably from 20 to 40° C., particularly preferably at ambient temperature.

The amount of suspension medium can, according to the invention, generally be selected so that a suspension which is readily stirrable and/or conveyable is obtained. In a preferred embodiment, the amount of mixture comprising at least one first material, at least one second material and at least one magnetic particle which is to be treated is, based on the total suspension, up to 100% by weight, particularly preferably from 0.5 to 10% by weight.

In a preferred embodiment of the process of the invention, the suspension produced in step (A) comprises at least one buffer system. Suitable buffer systems for setting a particular pH are known to those skilled in the art and are commercially available. A suitable buffer for a weakly acidic pH range (pH=5.0-6.2) is, for example, the carbonic acid-silicate buffer. A similar pH range (pH=5.2-6.7) can be set by means of 2-(N-morpholino)ethanesulfonic acid. A buffer suitable for a pH in the alkaline range (pH=8.2-10.2) is the ammonia buffer. The addition of a buffer system to the suspension in step (A) of the process of the invention serves to set a suitable pH which is relatively stable.

The suspension produced in step (A) of the process of the invention preferably has a pH of from 2 to 13. The pH of the suspension produced depends on the isoelectric points of the materials to be separated from one another. The limits of the pH range are also determined by the stability of the magnetic particles used, for example $Fe_3O_4$ is not stable below a pH of 2.88.

Step (B):

Step (B) of the process of the invention comprises the setting of the pH of the suspension obtained in step (A) to a value at which the at least one first material and the at least one magnetic particle bear opposite surface charges so that these agglomerate.

The agglomeration of the at least one first material and the at least one magnetic particle is based on their different surface charge in aqueous suspension as a function of the pH.

The surface charge of a particle in equilibrium with the surrounding liquid phase is determined by the zeta potential ξ. This varies as a function of the pH of the solution or suspension. At the isoelectric point (IEP), the sign of the surface charge on the particle changes, i.e. at exactly the isoelectric point, the zeta potential ξ measured is zero. If the zeta potential ξ is plotted on the y axis against the pH on the x axis on a system of coordinates, the resulting curve intersects the x axis and the isoelectric point.

Particles having different surface charges agglomerate with one another, while particles bearing the same charge repel one another.

In the suspension produced according to the invention, at least one first material, at least one second material and at least one magnetic particle having the isoelectric points IEP (1), IEP(2) and IEP(M) are present, where IEP(1)≦IEP(M)≦IEP(2). If the following relationship IEP(1)≦pH≦IEP(M) is obeyed, i.e. the pH of the suspension is between the isoelectric points of the at least one first material and the at least one magnetic particle, the at least one first material and the at least one magnetic particle have opposite surface charges, while the at least one second material and the at least one magnetic particle have the same surface charge, so that the at least one first material and the at least one magnetic particle agglomerate. Conversely, when the pH is between the isoelectric point of the at least one magnetic particle and the at least one second material, i.e. IEP(M)≦pH≦IEP(2), the at least one magnetic particle and the at least one second material agglomerate while the at least one magnetic particle and the at least one first material repel one another because of the like surface charge.

The isoelectric point of the materials present in the mixture comprising at least one first material, at least one second material and at least one magnetic particle can be determined via the ξ potential of the individual materials in aqueous solution. The ξ potential measured varies with the type of instrument used, the measurement method and the evaluation method. Important parameters are temperature, pH, concentration of the salt background solution, conductivity and measurement voltage, so that these parameters have to be known in order to be able to compare measurements.

Isoelectric points of various preferred metal oxides and sulfides are shown below by way of example:

Metal Oxides:

| No. | Metal oxide | Isoelectric point |
|---|---|---|
| 1 | Magnetite ($Fe_3O_4$) | 6.5 |
| 2 | alpha-Iron oxide ($Fe_2O_3$) | 8-9 |
| 3 | gamma-Iron oxide ($Fe_2O_3$) | 7 |
| 4 | Zinc oxide (ZnO) | 9-10 |
| 5 | Tin oxide ($SnO_2$) | 4-5.5 |
| 6 | Manganese oxide ($MnO_2$) | 4-5 |
| 7 | Tungsten oxide ($WO_3$) | <1 |
| 8 | Zirconium oxide ($ZrO_2$) | 4-7 |
| 9 | Titanium oxide ($TiO_2$) | 4-6 |
| 10 | Cerium oxide ($CeO_2$) | 7 |

-continued

| No. | Metal oxide | Isoelectric point |
|---|---|---|
| 11 | gamma-Aluminum oxide ($Al_2O_3$) | 7-8 |
| 12 | alpha-Aluminum oxide ($Al_2O_3$) | 8-9 |
| 13 | Yttrium oxide ($Y_2O_3$) | 9 |
| 14 | Copper oxide (Cuo) | 9.5 |
| 15 | Nickel oxide (NiO) | 10-11 |
| 16 | Chromium oxide ($Cr_2O_3$) | 7 |
| 17 | Vanadium oxide ($V_2O_5$) | 1-2 |
| 18 | delta-Manganese oxide ($MnO_2$) | 1.4 |
| 19 | beta-Manganese oxide ($MnO_2$) | 7.3 |
| 20 | Sintered nickel oxide (NiO) | 7.5 |

The isoelectric point (IEP) of $SiO_2$ is about 2. This result is measured on an "EKA" instrument from Anton Parr. The current partial measurement method is used (evaluation of data: Faibrother-Mastin): the temperature in the measurement is 25-30° C., the salt concentration (KCl) is 1 mmol/l and the conductivity is from 150 to 1000 μS/cm.

Metal Sulfides:

| No. | Metal sulfide | Isoelectric point |
|---|---|---|
| 21 | Pyrite (iron sulfide: $FeS_2$) | <3 |
| 22 | Iron sulfide (FeS) | <3 |
| 23 | Zinc sulfide (ZnS) | <3 |
| 24 | Nickel sulfide ($NiS_2$) | <3 |
| 25 | Cobalt sulfide ($CoS_2$) | <3 |
| 26 | Manganese sulfide ($MnS_2$) | <3 |
| 27 | Cadmium sulfide (CdS) | <3 |
| 28 | Copper sulfide (CuS) | <3 |
| 29 | Copper sulfide ($Cu_2S$) | <3 |
| 30 | Cobalt sulfide (CoS) | <3 |
| 31 | Manganese sulfide (MnS) | <3 |
| 32 | Molybdenum sulfide (MoS) | <3 |
| 33 | Molybdenum sulfide ($MoS_2$) | 1.4-2 |
| 34 | Molybdenum sulfide ($MoS_3$) | 1.9 |
| 35 | Cobalt sulfide ($Co_9S_8$) | 1.9 |
| 36 | Nickel sulfide (NiS) | 2.8 |
| 37 | Iron sulfide ($Fe_{1-x}S$) | 3.5 |

Details regarding the method of measuring the isoelectric points for these compounds may be found in the following documents:

Compounds 1 to 13: Brunelle J P (1978), "Preparation of Catalysts by Metallic Complex Adsorption on Mineral Oxides", Pure and Applied Chemistry Vol. 50, pages 1211-1229, Compounds 14 to 20: Lewis, J A (2000), "Colloidal Processing of Ceramics", Journal of the American Ceramic Society Vol. 83, No. 10, pages 2341-2359, Compounds 21 to 26: Bebie, Joakim; Geochimica et Cosmochimica Acta (1998), 62(4), 633-642, Compounds 27 to 32: Liu, J. C., Huang, C. P.; Langmuir (1992), 8(7), 1851-6, Compounds 33 to 37: Goboeloes, S.; Wu, Q.; Delmon, B.; Applied Catalysis (1984), 13(1), 89-100.

In a preferred embodiment of the process of the invention, the pH in step (B) is therefore set to a value between the isoelectric point of the at least one first material and the isoelectric point of the at least one magnetic particle.

The setting of the pH in step (B) of the process of the invention can be effected by all methods known to those skilled in the art, for example addition of at least one basic compound or at least one acidic compound to the suspension obtained in step (A). Whether a basic compound or an acidic compound has to be added depends on the pH of the suspension produced in step (A) of the process of the invention. If the pH of the suspension is below the range between the isoelectric point of the at least one first material and the isoelectric point of the at least one magnetic particle, at least one base is added to increase the pH. If the pH of the suspension is above the range between the isoelectric point of the at least one first material and the isoelectric point of the at least one magnetic particle, at least one acid is added to reduce the pH.

Suitable basic compounds are selected from the group consisting of organic and inorganic bases, for example ammonia, sodium hydroxide NaOH, potassium hydroxide KOH, amines, for example triethylamine, soluble alkali metal carbonates and mixtures thereof.

Suitable acidic compounds are selected from the group consisting of organic and inorganic acids, for example mineral acids such as hydrochloric acid, nitric acid, sulfuric acid, phosphoric acid, organic acids such as formic acid, acetic acid, propionic acid, methanesulfonic acid and mixtures thereof.

In step (B) of the process of the invention, the pH for separation of $Cu_2S$ from $SiO_2$ is preferably set to pH 3. To separate $MoS_2$ from $SiO_2$, the pH is preferably set to >2 in step (B) of the process of the invention.

Step (C):

Step (C) of the process of the invention comprises separation of the agglomerate obtained in step (B) from the suspension by application of a magnetic field.

Step (C) can, in a preferred embodiment, be carried out by introducing a permanent magnet into the reactor in which the mixture from step (B) is present. In a preferred embodiment, a dividing wall composed of nonmagnetic material, for example the glass wall of the reactor, is located between permanent magnet and the mixture to be treated. In a further preferred embodiment of the process of the invention, an electromagnet which is only magnetic when an electric current flows is used in step (D). Suitable apparatuses are known to those skilled in the art.

Step (C) of the process of the invention can be carried out at any suitable temperature, for example from 10 to 60° C., preferably ambient temperature.

During step (C), the mixture is preferably continually stirred by means of a suitable stirrer, for example a Teflon stirrer bar or a propeller stirrer.

In step (C), the agglomerate from step (B) can, if appropriate, be separated off by means of all methods known to those skilled in the art, for example by draining off the part of the suspension which is not held by the magnet through the bottom valve of the reactor utilized for step (C) or pumping away the part of the suspension which is not held by the at least one magnet through a hose.

After step (C) of the process of the invention, the agglomerate comprising at least one first material and at least one magnetic particle which is formed in step (B) of the process of the invention is present on the magnet or on a dividing wall located between magnet and agglomerate. In the case of an electromagnet, the agglomerate can be removed from the magnet by switching off the electric current, so that a magnetic field gradient is no longer present. If a dividing wall is present between the magnet and the suspension, the agglomerate can be removed by methods known to those skilled in the art.

Step (D):

Step (D) of the process of the invention comprises the dissociation of the agglomerate separated off in step (C) by setting the pH to a value at which the at least one first material and the at least one magnetic particle bear the same surface charges in order to obtain the at least one first material.

In a preferred embodiment of the process of the invention, the agglomerate comprising at least one first material and at least one magnetic particle which is obtained in step (C) is firstly resuspended in step (D). Here, it is possible to use the same suspension media as used in step (A), preferably water.

The dissociation of the agglomerate in step (D) of the process of the invention is based on the same principle as the agglomeration in step (B).

In step (B) according to the invention, the agglomeration of the at least one first material and the at least one magnetic particle is based on their different surface charges in aqueous suspension as a function of the pH.

In step (D) according to the invention, the pH of the suspension is now set so that the at least one first material and the at least one magnetic particle have the same surface charge, so that they repel one another.

In a preferred embodiment of the process of the invention, the pH in step (D) is set to a value which is not between the isoelectric point of the at least one first material and the isoelectric point of the at least one magnetic particle but is instead outside this range, i.e. above or below this range.

The setting of the pH in step (D) of the process of the invention can be effected by all methods known to those skilled in the art, for example by addition of at least one basic compound or at least one acidic compound to the agglomerate obtained in step (C), which is preferably present in suspension.

Suitable basic compounds are selected from the group consisting of organic and inorganic bases, for example ammonia, sodium hydroxide NaOH, potassium hydroxide KOH, amines, for example triethylamine, and mixtures thereof.

Suitable acidic compounds are selected from the group consisting of organic and inorganic acids, for example mineral acids such as hydrochloric acid, nitric acid, sulfuric acid, phosphoric acid, organic acids such as formic acid, acetic acid, propionic acid, sulfonic acid, acid salts such as $NaHSO_4$ and mixtures thereof.

After dissociation of the agglomerate, the at least one first material and the at least one magnetic particle are present in suspended form. These two materials can be separated from one another and from the suspension medium by all methods known to those skilled in the art.

The at least one magnetic particle is preferably separated off from the suspension comprising this at least one magnetic particle and the at least one first material by means of a permanent magnet or electromagnet. Details of the separation are analogous to step (C) of the process of the invention. After this separation, the at least one first material is preferably present in suspended form while the at least one magnetic particle adheres to the magnet.

The first material to be separated off, preferably the metal compound to be separated off, is preferably separated from the suspension medium by distilling off the solvent or filtration. The first material obtained in this way can be purified by further processes known to those skilled in the art. The suspension medium can, if appropriate after purification, be recirculated to the process of the invention. In a preferred embodiment, the at least one magnetic particle is likewise recirculated to step (A) of the process of the invention.

FIGURE

In FIG. 1, the value for the recovery R of $SiO_2$, $Cu_2S$ and $MoS_2$ is plotted against the pH. R is defined according to equation (I) as the % in the mixture after separation divided by the % in the mixture before separation.

$$R = \frac{\text{percentage after separation}}{\text{percentage before separation}} \quad (1)$$

If R is greater than 1, the compound concerned is present in a higher proportion in the mixture after separation than before separation, i.e. this compound can be enriched at this pH. If R is less than 1, the compound in question is present in a smaller proportion in the mixture after separation, i.e. this compound can be removed from the mixture at this pH.

EXAMPLES

The isoelectric points (IEPs) of the individual compounds on which the examples according to the invention are based are measured on an "EKA" instrument from Anton Parr. The current partial measurement method is used (evaluation of data: Faibrother-Mastin): the temperature in the measurement is 25-30° C., the salt concentration (KCl) is 1 mmol/l and the conductivity is from 150 to 1000 μS/cm.

Example 1

A mixture is produced from 0.0377 M of copper (used as $Cu_2S$), 0.1555 M of iron (used as $Fe_3O_4$) and 0.2996 M of silicon (used as $SiO_2$). These constituents are mixed with 1 l of deionized water. A pH of 3 is subsequently set and the system is provided with a buffer solution. The mixture is stirred vigorously for 1 h and the magnetic constituents are subsequently separated off using a Co/Sm magnet. Analysis of the residue indicated that 52.8% of the Cu constituents originally used, 84.8% of the Fe constituents originally used and 17.7% of the Si constituents originally used are recovered on the magnet. This residue is treated with 1 M NaOH and ultrasound for 0.5 h. After the residue on the magnet was reanalyzed, only 17.3% of the Cu are recovered on the magnet.

Example 2

3.00 g of $MoS_2$ (ABCR), 18.00 g of $SiO_2$ (Riedel de Häen) and 12.00 g of $CO_{0.25}Fe_{2.75}O_4$ (primary particle size: 100 nm-300 nm) in 1000 g of buffer solution (Riedel de Häen, pH=3) are mixed vigorously for a period of 30 minutes. The pH of the dispersion is set to 4.18. A magnet is positioned on one side of the glass vessel, so that the magnetic components are held thereon. The magnetic components are separated off. Analysis shows that the residue on the magnet comprises 2.14 g of $MoS_2$, corresponding to about 70% of the $MoS_2$ used, and only 3.57 g of $SiO_2$, corresponding to about 20% of the $SiO_2$ used.

The strong pH dependence of the separation can be seen when the experiment is repeated at pH=3.10. Although 75.97% of $MoS_2$ are held back on the magnet, 55.86% of $SiO_2$ are also still held back on the magnet.

The invention claimed is:

1. A process for separating at least one first material from a mixture comprising the at least one first material and at least one second material, comprising:

(A) suspending the mixture comprising at least one first material and at least one second material and at least one magnetic particle in a suitable suspension medium to obtain a suspension, (B) setting the pH of the suspension to a value at which the at least one first material and the at least one magnetic particle bear opposite surface charges to form an agglomerate, (C) separating the agglomerate from the suspension by application of a magnetic field to obtain a separated agglomerate and (D) dissociating the separated agglomerate by setting the pH to a value at which the at least one first material and the at least one magnetic particle bear the same surface charges to obtain the at least one first material, wherein the at least one first material is selected from the group consisting of sulfidic ores and mixtures thereof and the at least one second material is selected from the group consisting of an oxidic metal compound, a hydroxidic metal compound and mixtures thereof.

2. The process according to claim 1, wherein the pH in (B) is set to a value between the isoelectric point of the at least one first material and the isoelectric point of the at least one magnetic particle.

3. The process according to claim 1, wherein the at least one magnetic particle is selected from the group consisting of a magnetic metal, a ferromagnetic alloy of a magnetic metal, a magnetic iron oxide, a cubic ferrite of the general formula (I)

$$M^{2+}_{x}Fe^{2+}_{1-x}Fe^{3+}_{2}O_4 \quad (I),$$

where

M is selected from among Co, Ni, Mn, Zn, $x \leqq 1$, a hexagonal ferrite, and mixtures thereof.

4. The process according to claim 1, wherein the suspension medium is water.

5. The process according to claim 1, wherein the suspension comprises at least one buffer system.

6. The process according to claim 1, wherein the first material is $Cu_2S$ and the second material is $SiO_2$.

7. The process according to claim 1, wherein the first material is $MoS_2$ and the second material is $SiO_2$.

* * * * *